United States Patent [19]

Reissinger et al.

[11] 4,307,523

[45] Dec. 29, 1981

[54] STREET CLEARING DEVICE

[75] Inventors: Gottfried Reissinger, St. Heinrich, Fed. Rep. of Germany; Harro Reissinger, Haus Nr. 30, 8124 St. Heinrich, Fed. Rep. of Germany

[73] Assignee: Harro Reissinger, St. Heinrich, Fed. Rep. of Germany

[21] Appl. No.: 101,221

[22] Filed: Dec. 7, 1979

[30] Foreign Application Priority Data

Dec. 8, 1978 [DE] Fed. Rep. of Germany ..... 2853121
Dec. 8, 1978 [DE] Fed. Rep. of Germany ..... 2853126

[51] Int. Cl.[3] ..... E01H 5/06
[52] U.S. Cl. ..... 37/42 VL
[58] Field of Search ..... 37/41, 42 R, 42 VL, 37/50

[56] References Cited

U.S. PATENT DOCUMENTS 3,808,714 5/1974 Reissinger et al. ..... 37/42 VL

FOREIGN PATENT DOCUMENTS 2164525 6/1973 Fed. Rep. of Germany ... 37/42 VL
2519112 11/1976 Fed. Rep. of Germany ... 37/42 VL
2617235 10/1977 Fed. Rep. of Germany ... 37/42 VL
1949832 11/1977 Fed. Rep. of Germany ... 37/42 VL
2900904 7/1979 Fed. Rep. of Germany ... 37/42 VL
52-61008 5/1977 Japan ..... 37/42 VL

*Primary Examiner*—E. H. Eickholt
*Attorney, Agent, or Firm*—Burns, Doane, Swecker & Mathis

[57] ABSTRACT

A street clearing device comprises a share member mounted on a propulsion vehicle. A rotary member is rotatably supported below the share member. The rotary member carries a hard scraping blade and an elastic scraping blade mounted at spaced locations so that the blades may be alternately disposed in an operative position with respect to a surface to be cleared. The orientation of the rotary member is determined by an actuating assembly which includes a toggle lever and an adjustable mounting member connected to the toggle lever for adjusting the latter and thereby selectively rotate the rotary member. The actuating assembly further includes a spring operatively connected to the toggle lever to enable the toggle lever to yield in response to the hard blade striking an obstruction, but preventing the toggle lever from yielding when the elastic blade is in the operative position.

19 Claims, 14 Drawing Figures

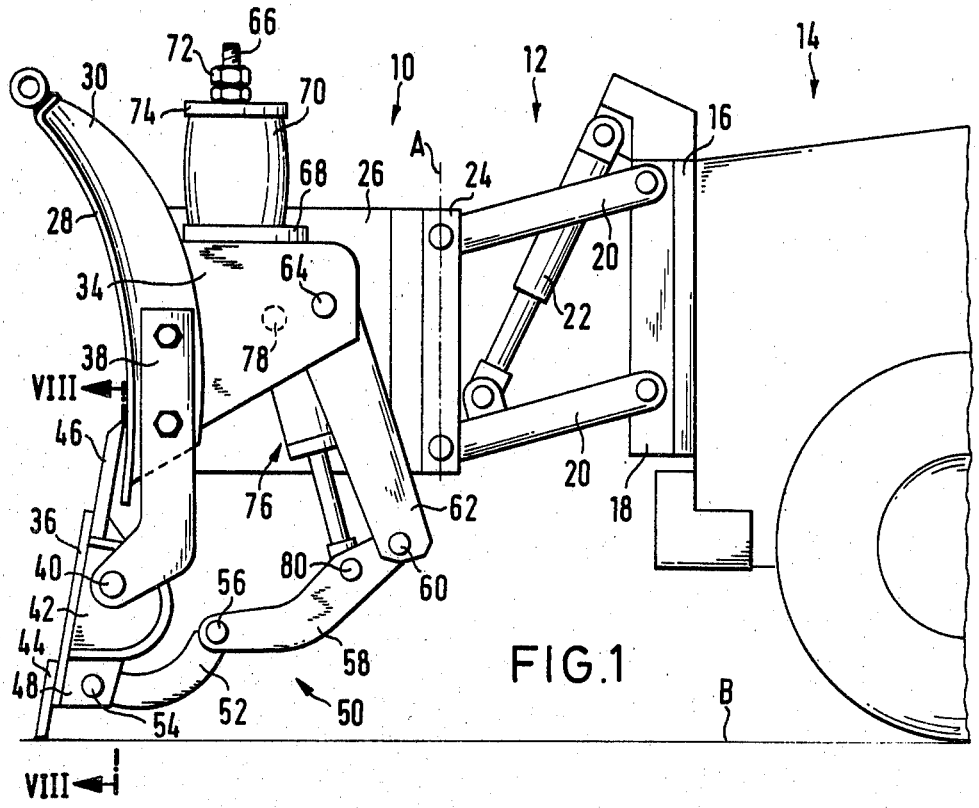
FIG.1
FIG. 8
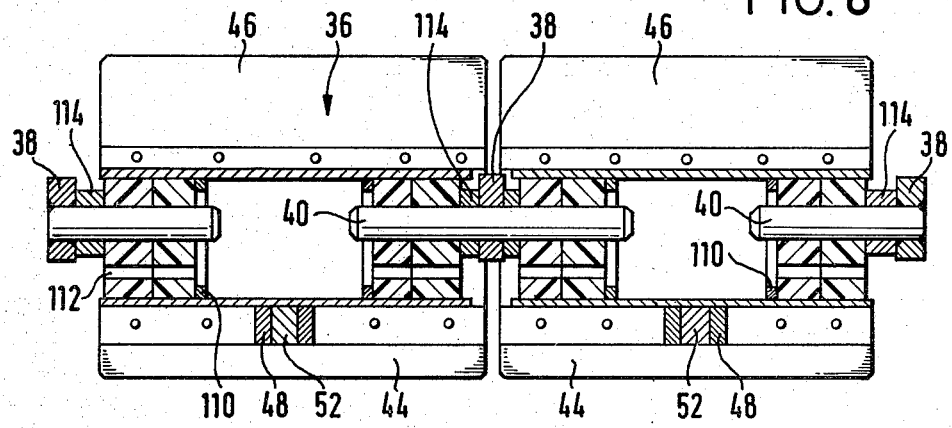

FIG. 9
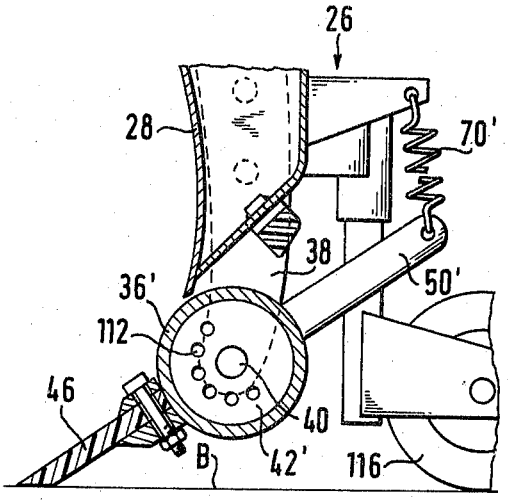
FIG. 10
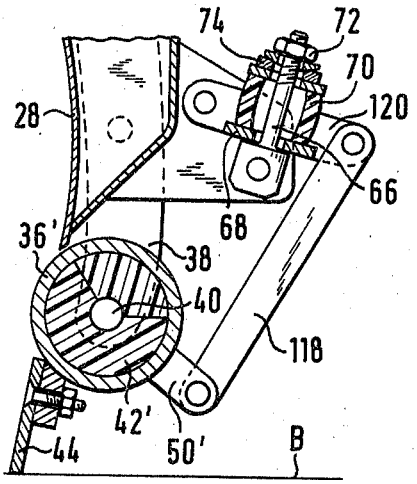
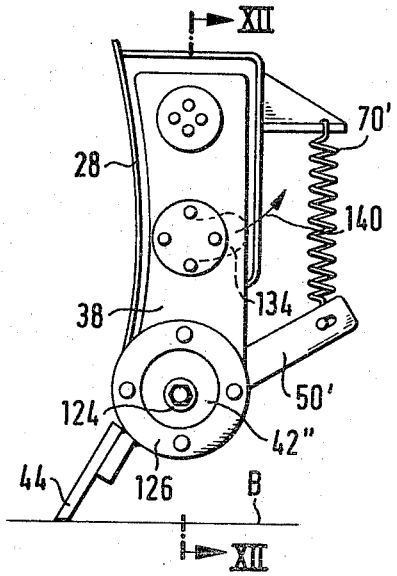
FIG. 11
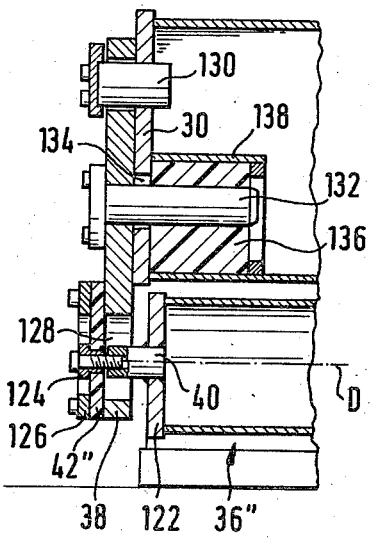
FIG. 12

STREET CLEARING DEVICE

The present invention relates to a street clearing device having a share member adapted to be moved by a vehicle over a surface to be cleared, a rotary member supported below the share member, a hard scraping blade and an elastic scraping blade mounted at an angle with respect to each other at said rotary member so that the hard or the elastic scraping blade selectively adopts an operative position with respect to the surface to be cleared, in dependence on the angle of rotation position of the rotary member, and the respective other scraping blade is oriented substantially upwardly or rearwardly, a toggle lever with two legs supporting the rotary member against rotation, and a mounting device holding the toggle lever at least approximately straight in the operative position of the hard scraping blade and bent in the operative position of the elastic scraping blade.

A street clearing device of this kind is known from our U.S. Pat. No. 3,808,714, FIGS. 5 and 5*a*. It comprises a rotary member supported on an intermediate member in the form of a roller sector which in turn is supported on a share member so as to pivot in upward direction about a pivot axis located behind the rotary member and parallel to the same. A toggle or knee lever is constituted by two rigid legs which are interconnected by a knee joint. The leg of the toggle lever remote from the rotary member is supported on the roller sector intermediate member near the pivot axis thereof. The mounting device provided is an hydraulic or pneumatic piston and cylinder unit, the piston rod of which is pivotally connected at the knee joint of the knee lever and the cylinder is pivotally supported at the roller sector intermediate member and contains two compression springs between which the piston of the mounting device is disposed.

With this known street clearing device pressurized air or oil can be introduced into the cylinder of the mounting device, preferably from the driver's cab of a pushing vehicle to bring the hard or the elastically yielding scraping blade selectively into operative position. Each of the two scraping blades can only leave its operative position and evade to the rear when it hits an obstacle during forward motion if the mounting device yields under the force exerted by the obstacle on the operating scraping blade so that the knee lever can bend. Such bending forced upon the device by the obstacle is possible only because the knee lever can never fully reach a stretched position by virtue of its arrangement and design so that, even with the hard scraping blade in operative position, the two legs of the lever enclose an angle which is noticeably smaller than 180°.

Each bending of the knee lever in the known street clearing device means that the piston rod which is pivotally connected with the knee joint pushes the piston of the pneumatic or hydraulic mounting device further into the cylinder, against the resistance of the pressurized air or oil and of the one spring disposed within the cylinder. As the pressurized oil is incompressible, the above cannot be effected in the case of an hydraulic cylinder unless the cylinder communicates through lines of sufficient cross sectional area with a pneumatic pressure reservoir. Such a pressure reservoir and the corresponding conduits, however, are expensive and thus considerable financial investment is required even if the particular pushing vehicle is equipped with an hydraulic system. If the mounting device, on the other hand, is a pneumatic piston and cylinder unit, the cylinder diameter must be very great to prevent the hard scraping blade from evading unintentionally to the back even if it is pressed under great force against the surface of the street and thus subjected to great forces acting toward the rear during clearing.

Another problem occurring with the known street clearing device is caused by the constant change of the resistance which the respective scraping blade in operation has to overcome on the street surface. This provokes constant relative movements between the individual structural elements of the mounting device thus leading to a considerable reduction of their service life, at least if satisfactory lubrication cannot be guaranteed because of very low temperatures.

Likewise known is a further development (DE-OS No. 21 06 927) of the street clearing device described above, with which the leg of the knee lever which is pivoted at the rotary member is elastically flexible by either being designed as a spring itself or by being connected with the knee joint of the toggle lever by a spring assembly. The second leg of the knee lever is designed to be rigid and is supported directly on the share member. The angle enclosed between the two legs already is an acute angle when the hard scraping blade is in operative position and is correspondingly smaller when the elastically yielding scraping blade is in operative position. The mounting device in this case again is a piston and cylinder unit, the piston rod of which is pivotally connected with the toggle lever in the vicinity of the knee joint, while the corresponding cylinder is supported on the share member.

In the case of this further development of the known street clearing device the design of the first leg of the knee lever so as to be resilient in longitudinal direction has the advantage that the shocks occurring during operation, in particular when working with the hard scraping blade are absorbed by the first leg so that they do not directly reach the mounting device. And yet the mounting device must withstand all forces acting on the knee joint and counteract them such that undesired evading motions of the scraping blades are avoided and, above all, the hard scraping blade actually can clear away even hard dried dirt or compacted snow. In this respect the problems occurring with the first mentioned street clearing device are less acute only in that the wear of the mounting device is less by virtue of the further development described. However, the mounting device of the street clearing device according to the further development still must be dimensioned very amply, which makes it expensive and requires a lot of space.

It is, therefore, an object of the instant invention to devise a street clearing device of the kind specified initially such that the evasion behavior of the hard scraping blade on the one hand and the design, dimension, and operation of the mounting device, on the other hand, are largely independent of each other.

This object is met, in accordance with the invention, in that both legs of the toggle lever, in their at least approximately straight position, are adapted to yield in their common longitudinal direction against the resistance of a biased spring and that the mounting device is so arranged that it remains substantially unloaded and unchanged in length when the hard scraping blade makes evading movements.

In this manner a functional separation is obtained between a resilient support of the rotary member, permitting each of the two scraping blades to carry out limited evading movements out of the operative position to the back, on the one hand, and the reciprocating rotational motion of the rotary member between the operative positions of the hard and of the elastically yielding scraping blades, on the other hand. The resistance of the hard scraping blade against forces directed toward the back and attacking at its lower edge, is influenced relatively little only, if at all, by the design and dimension of the mounting device but rather depends on the bias of the spring associated with the stretched toggle lever and determining the lonitudinal flexibility of the same. Consequently a weakly dimensioned mounting device of corresponding small space requirement does not prevent the hard scraping blade from engaging the street surface under great force so as to scrape off compacted dirt or hard frozen snow. The biased spring which determines the longitudinal flexibility of the stretched toggle lever is readily devised such that it can absorb shocks of considerable energy acting on the hard scraping blade, when in operative position, without any undesired great change of the angle of attack of the hard scraping blade with respect to the street surface. On the other hand, the hard scraping blade is adapted to evade to the rear against the resistance of the biased spring when it encounters obstacles which it cannot remove. And yet this does not cause any loading of the mounting device worth mentioning or effect any changes in length. Thus anyone using the street clearing device according to the invention can select a mounting device which will best meet his particular requirements or which is provided anyway at the pushing vehicle at his disposal.

The bias of the spring, on which depends the longitudinal flexibility of the stretched toggle lever, conveniently is adjustable so as to permit adaptations to different levels of wear of the hard scraping blade and to different road conditions.

In a preferred embodiment of the invention that end of the toggle lever which is remote from the rotary member is pivoted at a transmission lever which is supported on the share member, and the biased spring is clamped between the transmission lever and the share member and normally holds the transmission lever against a stop. The transmission lever makes it possible to dispose the biased spring at a location, in general relatively far above the toggle lever, where not even a spring of great volume will cause disturbance and where it will be accessible, if required, for varying its bias and where, at the same time, it will be largely protected against the risk of freezing. However, if there is sufficient space in the area of the end of the toggle lever remote from the rotary member, the biased spring may also be placed there so that it affords direct support of the toggle lever. In this manner, too, the required longitudinal resilience of the stretched toggle lever can be achieved by an elastic external support.

An elastic external support of the toggle lever can be dispensed with if the toggle lever, in its at least approximately straight position, can be pushed together in telescopic fashion, in accordance with another embodiment of the invention, and the biased spring is disposed on the toggle lever itself in such manner that it resists the telescoping movement.

The mounting device of the street clearing device according to the invention may be connected with the share member by a first joint and with the toggle lever by a second joint spaced from the first one. With this arrangement the indifference of the mounting device towards the rearwardly directed evasion movements of the hard scraping blade, aimed at by the invention, can be obtained in simple manner in that the first joint is spaced at least approximately equally from those positions which the second joint adopts when the hard scraping blade is in its operative position, on the one hand, and in its rearmost position of evasion on the other hand.

Yet the mounting device need not be connected directly with the share member. Its indifference vis a vis longitudinal movements of the stretched toggle lever also is obtained in particularly simple manner if the mounting device interconnects the legs of the toggle lever, thus bridging the knee joint.

If such terms as scraping blade, rotary member, toggle lever, biased spring, and mounting device are used in the singular in the preceding text, this does not mean that the use of several of the respective structural elements should be excluded. Quite on the contrary, it is advantageous with most street clearing devices to arrange two or more rotary members in mutual alignment, together with the corresponding scraping blades, below a common share member and to support each of these rotary members by its own toggle lever and operate it by its own mounting device, as also provided with the known street clearing device described initially.

It is a further object of the instant invention to provide a street clearing device of the kind specified initially, with which a functional separation is realized in particularly simple and operationally safe manner between a rotatable and upwardly resilient support of the rotary member, on the one hand, and the rotational elastic support of the rotary member on the other hand.

This object is met, according to a further aspect of the invention, in that the rotary member is supported so as to be resilient in upward direction at both ends in a bearing box each, enclosing at least one elastomeric body, a pivot pin rotatably supported therein, and at least one cavity for accommodating the volume of the elastomeric body displaced by the pivot pin as the rotary member yields upwardly.

This has the advantage that any upwardly directed shocks which act on the operating scraping blade or directly on the rotary member can already be taken up by the elastomeric bodies and absorbed by the same to a great extent so that subsequent structural elements are not loaded substantially by such shocks.The elastomeric bodies at both ends of the rotary member may become deformed to different degrees and/or in different directions in response to the point of attack and direction of the forces acting on the rotary member so that the operating scraping blade is always in a position to adapt well to the street surface. The given dimensions of the bearing boxes permit different divisions of the interior space to elastomeric bodies and cavities, depending on whether the rotary member is to work with an elastic scraping blade and thus need be pressed against the street surface at moderate force only, or whether it is to work with a hard scraping blade and a correspondingly high contact pressure. None of this has any essential influence on the rotational elasticity of the rotary member because, with a street clearing device of the kind improved in accordance with the invention, this depends essentially or exclusively on the lever-spring arrangement by means of which the rotary member is supported at the share member so as to be rotationally elastic.

Preferably, the elastomeric bodies are arranged so as to be resilient also in axial direction of the rotary member. This affords the additional advantage, without any additional structural expenditure worth mentioning, that the rotary member is spring supported also against axial or oblique shocks which occur, for example, when the operating scraping blade touches a curbstone.

The known street clearing device described of the kind defined initially has a hollow rotary member. Thus the given hollow space may be utilized in accordance with the invention in that the elastomeric bodies are arranged within the rotary member. In this event the bearing boxes are formed by the rotary member itself which is open at both front ends. The elastomeric bodies require no additional structural space. The rotary member may be filled over a greater or smaller part of its length with the elastomeric bodies, depending on the elastomeric material used and on the desired spring rate. The two corresponding pivot pins are supported in these elastomeric bodies. In this case the pivot pins may be fixed rigidly at the share member so that the mass sprung by the elastomeric bodies is embodied exclusively by the rotary member with one or two scraping blades attached to the same. In special cases, however, it may be convenient to fix the bearing boxes at the share member and the pivot pins at the rotary member.

If the elastomeric bodies are disposed in the rotary member and are to have an axial resilient effect in addition to their radial spring action, they are conveniently supported axially inwardly on internal projections of the rotary member.

When the elastomeric bodies are arranged inside the rotary member the spring effect obtained is particularly favorable if the pivot pins are disposed eccentrically with respect to the cross section of the rotary member such that their distance from the wall of the rotary member is greater in the areas of the elastomeric bodies which are pressure loaded during clearing than in the other areas of said elastomeric bodies.

Conveniently, the areas of the elastomeric bodies which are pressure loaded during clearing have a radial thickness which is at least just as great as the radius of the pivot pin. This dimension, in general, is sufficient to make it possible for the operating scraping blade to roll over obstacles without noticeably lifting the share member.

Finally, an additional possibility of elastic evasion of the rotary member may be obtained by fixing the pivot pins or the elastomeric bodies at lateral webs which are supported on the share member in such manner that they can pivot to the rear against the resistance of additional elastomeric bodies.

Embodiments of the invention will be described below with reference to the accompanying diagrammatic drawings, in which:

FIG. 1 is a side elevational view of a street clearing device in accordance with the invention, connected with a vehicle by means of a lifting device;

FIG. 8 is a sectional view taken on line VIII—VIII of FIG. 1;

FIG. 9 is a vertical part sectional view of a second embodiment;

FIG. 10 is a corresponding part sectional view of a third embodiment;

FIG. 11 is a side elevational view of a third embodiment;

FIG. 12 is a sectional view taken on line XII—XII in FIG. 11.

Figure 2:
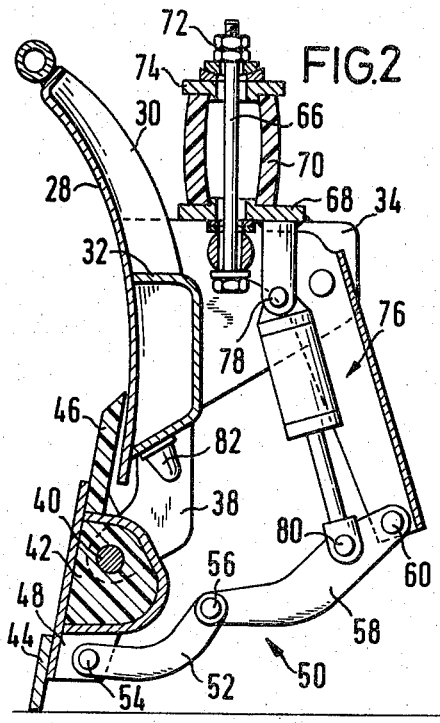
FIG. 2 is a vertical sectional view of the street clearing device parallel to the plane of the drawing of FIG. 1, showing a first, hard scraping blade in operative position.

The street clearing device 10, a snowplow, shown in FIGS. 1 and 2 is connected by a lifting device 12 with a vehicle 14, for instance, a truck. For this purpose a vertical vehicle plate 16 is fixed at the front end of the vehicle 14 and is releaseably connected with an accessory plate 18 belonging to the lifting device 12, for example by means of screws or semi- or fully automatic coupling devices. In addition to the accessory plate 18, the lifting device 12 comprises parallelogram links 20 and a piston and cylinder unit 22 connecting a carrier member 24 of the street clearing device 10 with the vehicle 14 in a manner so that the carrier member can be lifted and lowered. A share member 26 is supported on the carrier member 24 for pivotable adjustment about a vertical axis A. The share member 26 comprises a curved ploughshare 28 and crescent-shaped reinforcing plates 30 arranged at the backside of the ploughshare in parallel vertical planes, and a horizontal hollow transverse beam 32 which is welded to the ploughshare 28 and the reinforcing plates 30. In addition, the crescent-shaped reinforcing plates 30 are connected in pairs at their backside by brackets 34.

Below the share member 26 tow aligned hollow rotary members 36 which are rotatable independently are supported between two webs 38 each which are fixed to the share member 26. The webs 38 each comprise a pivot pin 40 which supports the rotary member 36 and extends eccentrically into the adjacent open front end of the respective rotary member 36 where it is rotatably received in elastomeric bodies 42.

Figure 4:
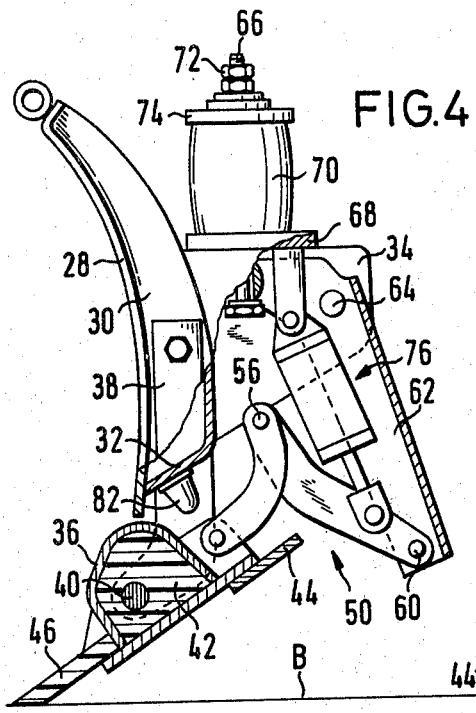
FIG. 4 is a corresponding sectional view showing a second, elastically yielding scraping blade in operative position.

A hard scraping blade 44 each of steel and an elastic scraping blade 46 of an elastormeric material, offset with respect to said hard scraping blade by 180°, are exchangeably secured at the rotary member 36. FIGS. 1 and 2 show the hard scraping blade 44 in its operative position in which it includes an angle of, for example, 80° with the street surface B, the elastic scraping blade 46 being directed to the top and abutting against the front side of the ploughshare 28. FIG. 4, on the other hand, shows the elastic scraping blade 46 in its operative position in which it is inclined by about 30° forwardly and downwardly with respect to the street surface B. The hard scraping blade 44 in this instance is directed obliquely upwardly to the back.

Each rotary member 36 has an unround cross section which is eccentric with respect to the pivot pin 40 such that the rotary member is spaced considerably from the lower edge of the ploughshare 28 when the hard scraping blade 44 is in operative position according to FIGS. 1 and 2. This spacing accommodates upwardly directed resilient movements of the rotary member 36 which are permitted by the elasticity of the elastomeric bodies 42, the spacing between the rotary member 36 and the lower edge of the ploughshare 28 being bridged by the elastic scraping blade 46. On the other hand, when the elastic scraping blade 46 is in operative position, hardly any spacing remains between the rotary member 36 and the lower edge of the ploughshare 28 so that the material scraped off by the elastic scraping blade 46 may flow readily over the rotary member 36 into the ploughshare 28.

A lug 48 each is welded to both rotary members 36 behind the hard scraping blade 44. A toggle lever 50 which is pivotable in a vertical plane is supported on said lug by its front leg 52 by means of a front joint 54. The front leg 52 of each of the two toggle levers 50 is connected by a knee joint 56 with its rear leg 58 which in turn is supported by a rear joint 60 on a further structural member connected with the share member 26. In this respect the embodiment shown in FIGS. 1 to 4 corresponds with that of FIGS. 5 and 6.

Figure 3:
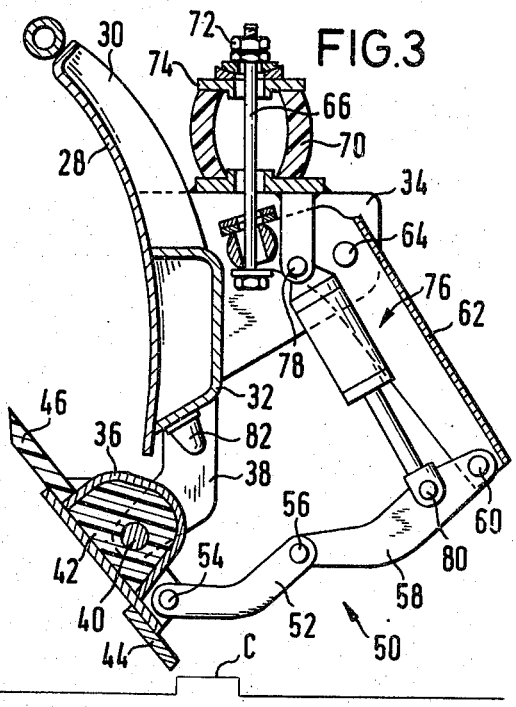
FIG. 3 is a corresponding sectional view showing the hard scraping blade in a position of evasion.

In the case of the embodiment according to FIGS. 1 to 4 the further structural member with which the rear leg 58 is connected by the joint 60 is a transmission lever 62 supported at the bracket 34, which is shown cut open in FIGS. 2 to 4, by means of a journal pin 64 extending parallel to the pivot pins 40 and the axes of the joints 54 and 60. The transmission lever 62 has a long lower arm at the lower end of which the joint 60 is disposed and a short upper arm which is bent at an angle toward the front and pivotally connected at its front end with a tie bolt 66. The tie bolt 66 extends vertically upwardly through a recess in a stop member 68 formed by a horizontal plate which is welded on top of the bracket 34. The stop member 68 defines the upper limit of the pivoting range of the upper arm of the transmission lever 62 and thus also limits the pivoting range of the lower arm of the transmission lever 62 toward the front. A spring 70 rests on the stop member 68. In the example shown, the spring is formed by a hollow body of an elastomeric material. The tie bolt 66 extends through the spring 70 and keeps the same biased by means of adjustable nuts 72 and a pressure plate 74. The upper arm of the transmission lever 62 normally abuts against the underside of the stop member 68 at the same bias.

The operative positions of the scraping blades 44 and 46 are determined by a mounting device 76 which holds the toggle lever 50 in an at least approximately straight or stretched position when the hard scraping blade 44 is in its operative position as shown in FIGS. 1 and 2. When the elastic scraping blade 46, on the other hand, is in its operative position, according to FIG. 4, the toggle lever 50 is held in a position which is strongly bent upwardly. For this purpose the mounting device 76 of the embodiment according to FIGS. 1 to 4 is connected by an upper joint 78 with the share member 26 and by a lower joint 80 with the rear leg 58 of the toggle lever 50, spaced from the rear joint 60 of the latter.

The mounting device 76 is shown to be a pneumatic or an hydraulic piston and cylinder unit. Yet it could also be embodied by a simple bar, for instance of flat bar steel supported by means of an upper hole at joint 78 and selectively supportable by means of one or the other of two holes spaced differently from the upper hole at joint 80, depending on whether the hard scraping blade 44 or the elastic scraping blade 46 is to adopt its operative position. Another purely mechanical embodiment would be the design of the mounting device 76 as a threaded spindle mounted for pivoting and rotating movement at the upper joint 78 and screwed into a nut supported at the lower joint 80.

Regardless of how the details of the mounting device 76 are designed, the joints 78 and 80 are so disposed that joint 80 does not change its spacing from joint 78 at all or only inessentially when the hard scraping blade 44 becomes stuck at an obstacle C and thus is moved against the resistance of the spring 70 out of its normal operative position according to FIG. 2 into a position of evasion shown in FIG. 3. At least in the rearmost position of evasion which the hard scraping blade 44 and thus the transmission lever 62 can adopt, the distance of joint 80 from joint 78 should correspond most exactly to the distance between the two joints in the normal operative position according to FIG. 2. This guarantees that on the way out of the normal operative position of the hard scraping blade 44 according to FIG. 2 into the position of evasion, the toggle lever 50 maintains its at least approximately straight position and thus transmits the shock exerted by obstacle C on the hard scraping blade 44 exclusively or almost exclusively by way of the transmission lever 62 to the spring 70 without, however, loading or at least not remarkably loading the mounting device 76. Therefore, if the mounting device 76 is designed as a pneumatic or an hydraulic piston and cylinder unit, as shown, and is completely extended when the hard scraping blade 44 is in its operative position according to FIG. 2, it maintains this fully extended position even if the hard scraping blade 44 evades an obstacle C according to FIG. 3. In the example shown, the rotary member 36 can rotate by an angle of approximately 60°.

Contrary to such a rotation which is forced upon the rotary member 36 by an obstacle C, the much greater rotation from the operative position of the hard scraping blade 44 into the operative position of the elastic scraping blade 46 is obtained by adjustment of the mounting device 76 and only by such adjustment. If the mounting device 76 is a pneumatic or an hydraulic piston and cylinder unit, as shown, it is fully retracted according to FIG. 4 in order to bring the elastic scraping blade 46 into its operative position. The elastic scraping blade 46 can make minor evasive movements in both directions of rotation by virtue of the elasticity of the support of the rotary member 36 at the pivot pins 40. The possibility of the elastic scraping blade 46 to make evasive movements to the top, i.e. in clockwise direction according to FIG. 4, also depends on the bias of the spring 70. A buffer 82 of an elastomeric material cooperating with the lug 48 is fixed at the underside of the transverse beam 32 so as to limit opposed movements of evasion, in other words counterclockwise rotations of the rotary member 36 out of the operative position of the elastic scraping blade 46.

Figure 5:
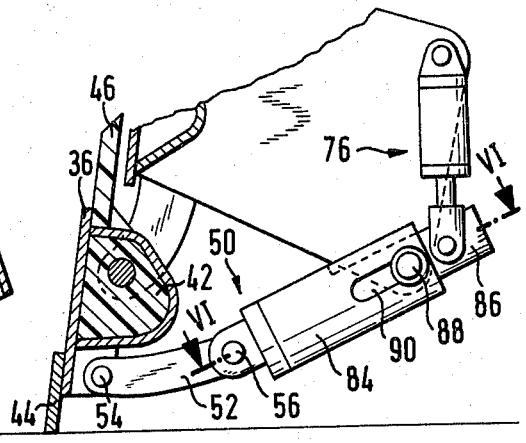
FIG. 5 is a detail of FIGS. 1 and 2 in a modified embodiment.
Figure 6:
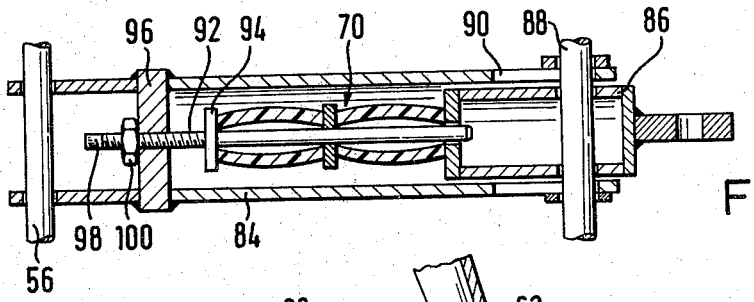
FIG. 6 is a sectional view taken on line VI—VI of FIG. 5.

The embodiment according to FIGS. 5 and 6 differs from the one shown in FIGS. 1 to 4 above all in that the rear leg 58 of the toggle lever 50 is not made rigid and in one piece but instead is a multipart leg which is resilient in itself in longitudinal direction. For this purpose the rear leg 58 according to FIGS. 5 and 6 is composed in telescope fashion of an outer tube 84 and an inner tube 86. Instead of the rear joint 60 which connects the rear leg 58 with the transmission lever 62 according to FIGS. 1 to 4, a rear joint in the embodiment according to FIGS. 5 and 6 is formed by a transverse bolt 88 which is fixed to the inner tube 86 and extends through elongated holes 90 in the outer tube 84 and is supported directly on the share member 26. An axially disposed bar 92 provided with a shoulder 94 is guided in the inner tube 86.

According to FIG. 6 the spring 70, against the bias of which the stretched toggle lever 50 is resilient in its longitudinal direction, is clamped within the outer tube 84 between the shoulder 94 and the opposite front end face of the inner tube 86. The bar 92 is threaded in its front portion which is remote from the inner tube 86 so that the bias of the spring 70 may be varied. Besides, it is screwed into a traverse member which is welded to the outer tube 84, and it is provided with a key square shank 98 and secured by a nut 100.

Another difference between the embodiment according to FIGS. 5 and 6 and that shown in FIGS. 1 to 4 resides in the fact that the lower joint 80 connecting the mounting device 76 with the toggle lever 50 is not disposed between the front joint 54 and the rear joint 60 but instead at the rear end of a rearward extension of the inner tube 86.

In the case of the embodiment according to FIGS. 5 and 6 movements of evasion of the hard scraping blade 44 to the back are made possible by the fact that the tubes 84 and 86 can be pushed further into each other in telescopic fashion against the resistance of the spring 70. In the extreme case this movement may be continued until the left limits of the elongated holes 90 abut against the transverse bolt 88. Minor pivoting motions of the tubes 84 and 86 about the transverse bolt 88 cannot be avoided. Yet they can be kept so small that they have no influence worth mentioning on the mounting device 76. If it is desired that the mounting device 76 should be not only essentially indifferent but completely indifferent with respect to such pivoting motions, the joint 78 and/or the joint 80 may be provided with corresponding clearance.

Figure 7:
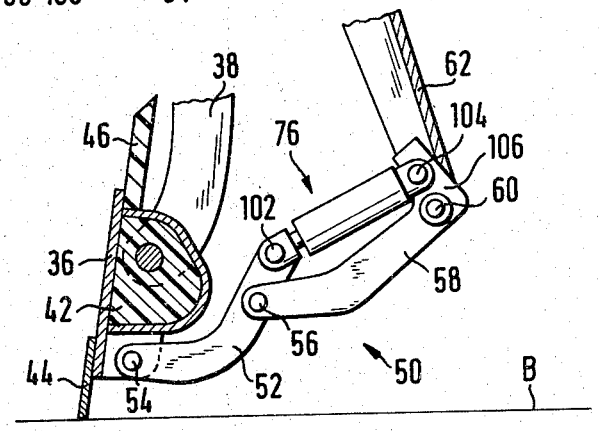
FIG. 7 is a detail of FIG. 1 in another modified embodiment.

In the embodiment according to FIG. 7 the toggle lever 50 is in agreement with the embodiment of FIGS. 1 to 4 and consists of two rigid legs 52 and 58 which are connected by a joint each 54 and 60 with the rotary member 36 and the transmission lever 62, respectively, and interconnected by the knee joint 56. Here again the mounting device 76 is an hydraulic or pneumatic piston and cylinder unit. Yet in this case the piston rod is connected by a joint 102 with the front leg 52 of the toggle lever 50, while the cylinder of the mounting device 76 is connected by a joint 104 with a bend 106 of the rear leg 52 of the toggle lever 50. Thus the mounting device 76 bridges the knee joint 56 and takes part in all movements of evasion of the stretched toggle lever 50 without influencing them in any other way than by its mass inertia.

As shown in FIGS. 1 to 8 the rotary members 36 are hollow, have an unround cross section, and are open at both front end faces. Each rotary member 36 forms a bearing box each at both its ends. The bearing box is limited axially inwardly by a projection 110 in the form of an annular disc. The inner diameter of each annular disc-shaped projection 110 is much greater than the diameter of the corresponding pivot pin 40 so that the pivot pins may carry out radial resilient movements against the elastic resistance of the elastomeric bodies 42 in which they are received. As shown in FIG. 2, each pivot pin 40 is disposed eccentrically directly in two disc-shaped elastomeric bodies 42 such that its spacing from the wall of the rotary member 36 in the lower areas of the elastomeric bodies 42 which are pressure loaded during clearing is greater than in those areas of the elastomeric bodies 42 which are located laterally of and above the pivot pin 40. The lower areas of the elastomeric bodies 42 have a radial thickness which is approximately twice as great as the diameter of the pivot pins 40. The elastomeric bodies 42 give both rotary members 36 the possibility to evade to the top independently of each other and, if necessary, to different degrees at both ends when the scraping blade in operation fixed at the respective rotary member - being the hard scrape blade 44 according to FIG. 1 - moves over an unevenness in the road or hits against an obstacle. During each upwardly directed movement of one or both ends, designed as bearing boxes of a rotary member 36, part of the volume of the elastomeric body is displaced from the space between the lower wall of the bearing box and the corresponding pivot pin 40. As shown in FIG. 8, this may happen in axial direction since the bearing boxes are open in part axially outwardly as well as inwardly. The elastomeric bodies 42 have a plurality of recesses 112 at the ends remote from each other of the two rotary members 36 so as to provide additional space for displacement of part of the volume of the elastomeric body.

It may be seen in FIG. 8 that spacer rings 114 are mounted on the pivot pins 40 to define a spacing between each web 38 and the adjacent elastomeric body 42, said spacer rings having an outer diameter which is much smaller than the smallest outer diameter of the adjacent elastomeric body 42. This gives the rotary members 36 the possibility to carry out resilient movements also in axial direction of the pivot pins 40 against the elastic resistance of the elastomeric bodies 42 which are clamped between the spacer rings 114 and the annular disc-shaped projections 114.

The embodiment of a street clearing device according to FIG. 9 is intended in particular for clearing wet snow. It has a simplified tubular rotary member 36' with only one elastic scraping blade 46 fixed to the same. In this case, too, the rotary member 36' has both open ends at its front end faces designed as bearing boxes, and each of these bearing boxes contains an elastomeric body 42' in which the corresponding pivot pin 40 is rotatably supported, in this case centrically. Instead of the toggle lever 50 shown in FIG. 1, a simple lever 50' is fixed at rotary member 36' and connected with the share member 26 by a spring 70' which in this case is formed as a helical tension spring. The share member 26 according to FIG. 3 has its own running wheels 116 which are supported so as to be adjustable in height in order to limit the pressure by which the elastic scraping blade 46 is pressed against the street surface B.

The embodiment shown in FIG. 10 is a street clearing device intended in particular for removing a compacted or frozen layer of snow. This embodiment differs from FIG. 9 in that the rotary member 36' which again is of circular cylindrical shape carries a hard scraping blade 44 as the only scraping blade. It is arranged at a much steeper angle with respect to the street surface B than the elastic scraping blade 46 according to FIG. 9. In agreement with FIG. 9, the pivot pins 40 according to FIG. 10 are supported centrically in circular cylindrical elastomeric bodies 42'. The elastomeric bodies 42', however, are made of materials of different degrees of hardness, the harder one filling a greater lower sector and the softer one a smaller upper sector. Suitable materials for these elastomeric bodies are especially polyurethane foams of different hardness which may have been foamed directly within the rotary member 36.

Similar to FIG. 9 a simple lever 50' is fixed to the rotary member 36' of the embodiment shown in FIG. 10. In this case, however, it is connected by a rigid coupling member 118 with a guide rod 120. The guide rod 120 is supported on the share member 26 by means of a spring 70, in a manner similar to the transmission lever 62 shown in FIG. 1.

The embodiment illustrated in FIGS. 11 and 12 differs from those according to FIGS. 1 to 10 above all in that the or each rotary member 36'' is closed at both ends by an end wall 122 each. A pivot pin 40 is welded to each end wall 122, and a bearing bushing 124 is screwed on the free end of the pivot pin 40. Each bearing bushing 124 is rotatably supported eccentrically in a diaphragm-like elastomeric body 42''. The outer edge of each elastomeric body 42'' is clamped between the corresponding web 38 and a housing ring 126 which is screw-connected with the web. Each web 38 is formed with a circular recess 128 which surrounds the corresponding pivot pin 40' and the diameter of which is a multiple of that of the pivot pin 40'. The eccentricity of the bearing pins 40'' with respect to the elastomeric bodies 42'' is such that the axis of rotation D of the rotary member 36'' determined by the pivot pins is offset toward the bottom with regard to the center of the housing rings 126.

As shown in FIG. 12, each of the diaphragm-like elastomeric bodies 42'' is clamped between the pivot pin 40 and the bearing bushing 124 such that it will resiliently resist axial movements of the rotary member 36''. As with the embodiments according to FIGS. 1 to 10, the or each rotary member 36'' according to FIGS. 11 and 12 has considerable axial clearance between the two respective webs 38 so as to carry out axial movements of evasion against the resistance of the elastomeric bodies 42'' if the rotary member itself or the operating scraping blade 44 hits laterally against an obstacle.

The webs 38 of the embodiment according to FIGS. 11 and 12 are pivotally supported on a pin 130 each, fixed at the share member 26 and extending parallel to the axis of rotation D. Parallel to the pin 130 a corresponding bolt 132 is fixed at each web 38 so as to extend through an arcuate recess 134 concentric with the pin 130 in the adjacent crescent-shaped reinforcing plate 30 and to be received in an additional elastomeric body 136. The elastomeric body 136 is enclosed by a housing 138 fixed at the share member 26. This gives each web 38 the opportunity to carry out limited pivoting movements to the back in the direction of the arrow 140 in FIG. 5 against the elastic resistance of the corresponding elastomeric body 136 when the operating scraping blade 44 hits against an obstacle. Such an elastic arrangement of the webs 38 may also be provided in the embodiments shown in FIGS. 1 to 10.

Figure 13:
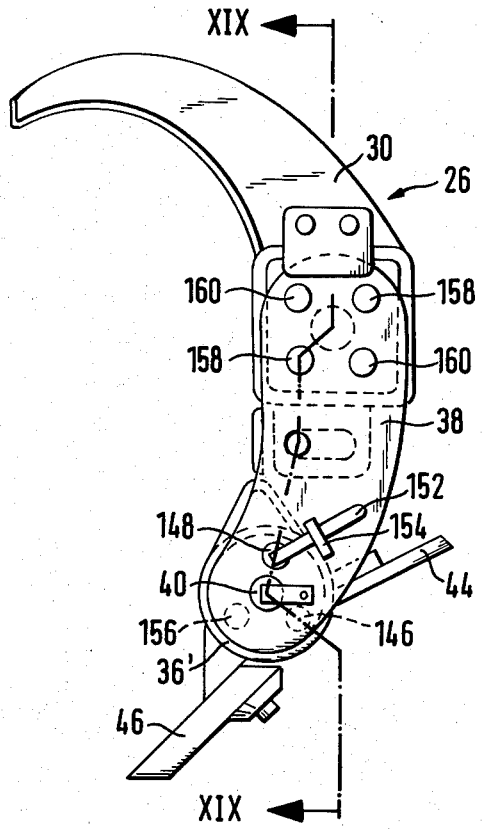
FIG. 13 is a detail of FIG. 1 in another modified embodiment.
Figure 14:
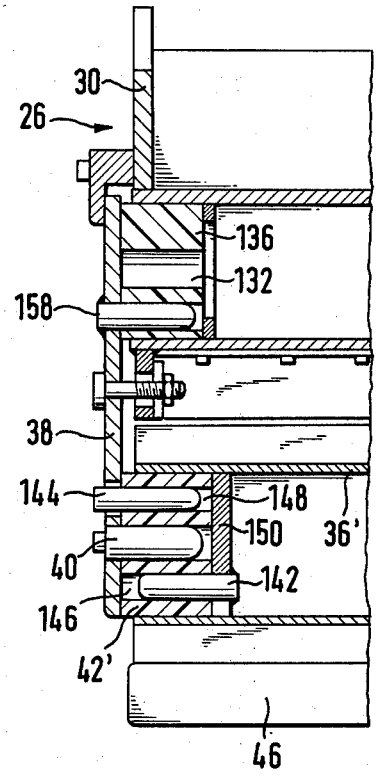
FIG. 14 is a sectional view taken on line XIV—XIV of FIG. 13.

The embodiment shown in FIGS. 13 and 14 differs from the one according to FIGS. 1 to 4 mainly in that the toggle lever 50, the transmission lever 62, the spring 70, and the mounting device 76 are omitted and that the elastomeric bodies 42' essentially have the same shape as in FIG. 9.

On the other hand, the embodiment according to FIGS. 13 and 14 comprises two additional structural elements, namely bolts 142 and 144, both extending parallel to the pivot pin 40 through a hole each 146 and 148, respectively, in the corresponding elastomeric body 42'. Bolt 142 is fixed to a plate 150 which in turn is fixed to rotary member 36', such as by welding. Bolt 144 on the other hand is removably inserted in the adjacent web 38 and, thereby, connected with the share member 26. A handle 152 extends radially from the outer end of the bolt 144 and is engaged by a catch 154 secured to the web 38. In this manner the bolt 144 is held against unintentional removal.

The holes 146 and 148 in the elastomeric body 42' are angularly spaced from each other by about 140°. A third hole 156 is formed in the elastomeric body 42' which is likewise spaced by an angle of about 140° from the hole 148 and thus by about 80° from the hole 146.

According to FIGS. 13 and 14 the bolts 142 and 144 and the elastomeric bodies 42' serve to hold the rotary member 36' elastically in an angle of rotation position at which the elastic scraping blade 46 secured to said rotary member is in operative position. Upon withdrawal of the bolt 144 from the hole 148 the rotary member 36' can be turned by about 140° into an angle of rotation position which corresponds to the one shown in FIG. 1 and at which the hard scraping blade 44 is in its operative position. The rotary member 36' may be held elastically in this angle of rotation position by inserting the bolt 144 into the hole 156.

The pin 130 shown in FIG. 12 is omitted in the embodiment according to FIGS. 13 and 14 where, instead, the bolt 132 defines a pivot axis for the web 38. In agreement with FIG. 12 the bolt 132 of the embodiment according to FIGS. 13 and 14 is disposed in an elastomeric body 136 in which two further bolts 158 are inserted which are likewise secured to the web 38, as is bolt 132. Furthermore, two bolts 160 are inserted in the elastomeric body 136 which are secured to the adjacent reinforcing plate 30. Thus the elastomeric body 136 according to FIGS. 13 and 14 constitutes a torsion spring.

What we claim is:

1. A street clearing device comprising:

a share member adapted to be moved by a vehicle over a surface to be cleared, a rotary member rotatably supported below the share member, a hard scraping blade and an elastic scraping blade mounted at spaced locations on the rotary member so that the hard or the elastic scraping blade selectively adopts an operative position with respect to the surface to be cleared, in dependence on the angular position of rotation of the rotary member, while the respective other scraping blade is oriented substantially upwardly or rearwardly, a toggle lever including two legs operably connected to the rotary member, the angular relationship between the legs being adjustable to determine the rotary position of the rotary member, wherein:

the hard scraping blade is in the operative position when the legs are at least approximately straight, and the elastic scraping blade is in the operative position when the legs are in a prescribed relatively angled position, an adjustable mounting means connected to the toggle lever for maintaining the angular relationship between the legs, said mounting means having:

a first position of adjustment for maintaining the toggle legs in their approximately straight condition to establish the operative positioning of the hard scraping blade, and a second position of adjustment for maintaining the toggle legs in their prescribed relatively angled condition to establish the operative positioning of the elastic scraping blade, a spring operably connected to the toggle lever to yieldably hold the operatively positioned blade in its operative position, the adjustable mounting means, in its first position of adjustment preventing relative angular movement between the toggle legs, the toggle legs being movable together rearwardly in their approximately straight condition against the bias of the spring, with the adjustable mounting means remaining in its first position of adjustment, to enable the rotary member to rotate in response to the hard blade striking an obstruction.

2. The street clearing device as claimed in claim 1 including means for adjusting the bias of the spring.

3. The street clearing device as claimed in claim 1 or 2, wherein the end of the toggle lever remote from the rotary member is pivotally connected with a transmission lever supported on the share member, and wherein the spring is clamped between the transmission lever and the share member and normally holds the transmission lever against an abutment.

4. The street clearing device as claimed in claim 1, wherein the toggle lever is adapted to be telescoped together, when in its at least approximately straight position, and the biased spring is mounted on the toggle lever proper such that it resists said telescoping movement.

5. The street clearing device as claimed in claim 1, wherein the mounting means is connected with the share member by a first joint and with the toggle lever by a second joint spaced therefrom, the first joint being spaced at least approximately equally from the positions which the second joint adopts when the hard scraping blade is in its operative position on the one hand and in its rearmost position of obstruction on the other hand.

6. The street clearing device as claimed in claim 1, wherein the mounting means interconnects the legs of the toggle lever.

7. The street clearing device as claimed in claim 1, wherein said adjustable mounting means is adjustable in length, said adjustable mounting means maintaining a constant length in its first position of adjustment as the toggle lever moves rearwardly.

8. A street clearing device having a share member adapted to be moved by a vehicle over a surface to be cleared, a rotary member supported on the share member for rotation and so as to yield resiliently upwardly, at least one scraping blade secured to the rotary member, and at least one lever and a spring by means of which the rotary member is supported elastically for rotation, wherein the rotary member is supported so as to be resilient in upward direction at both ends in a bearing box each, enclosing at least one elastomeric body, a pivot pin rotatably supported therein, and at least one cavity for accommodating the volume of the elastomeric body displaced by the pivot pin as the rotary member yields upwardly.

9. The street clearing device as claimed in claim 8, wherein the elastomeric bodies are arranged to be resilient in axial direction of the rotary member as well.

10. The street clearing device as claimed in claim 8 or 9, having a hollow rotary member, wherein the bearing boxes are formed by the rotary member itself which is open at both end faces.

11. The street clearing device as claimed in claim 9, wherein the elastomeric bodies are supported axially inwardly on internal projections of the rotary member.

12. The street clearing device as claimed in claim 10, wherein the pivot pins are disposed eccentrically with respect to the cross section of the rotary member such that their spacing from the wall of the rotary member is greater in the areas of the elastomeric bodies which are pressure loaded during clearing than in the other areas thereof.

13. The street clearing device as claimed in claim 8 or 9, wherein the areas of the elastomeric bodies which are pressure loaded during clearing have a radial thickness which is at least as great as the radius of the pivot pin.

14. The street clearing device as claimed in claim 8 or 9, wherein the pivot pins or the elastomeric bodies are fixed at lateral webs which are supported on the share member for pivoting to the rear, against the resistance of additional elastomeric bodies.

15. The street clearing device as claimed in claim 8 or 9, wherein at least one of the elastomeric bodies is designed as a torsion spring connecting the share member with the rotary member.

16. The street clearing device as claimed in claim 15, wherein at least two bolts extending parallel to the pivot pin are disposed in the at least one elastomeric body designed as a torsion spring, one of said bolts being connected with the share member and another one with the rotary member.

17. A street clearing device comprising:

a share member adapted to be moved by a vehicle over a surface to be cleared, a rotary member supported below the share member, a hard scraping blade and an elastic scraping blade mounted at an angle with respect to each other on said rotary member so that the hard or the elastic scraping blade selectively adopts an operative position with respect to the surface to be cleared, in dependence on the angle of rotation position of the rotary member, and the respective other scraping blade is oriented substantially upwardly or rearwardly, a toggle lever with two legs supporting the rotary member against rotation, a mounting device holding the toggle lever at least approximately straight in the operative position of the hard scraping blade and bent in the operative position of the elastic scraping blade, wherein both legs of the toggle lever are adapted to yield, against the resistance of a biased spring, in their common longitudinal direction, when in their at least approximately straight position, so as to permit the hard scraping blade to make evading movements to the rear, wherein the mounting device is so arranged that it remains at least substantially unloaded and unchanged in length during evading movements of the hard scraping blade, and wherein the end of the toggle lever remote from the rotary member is pivotally connected with a transmission lever supported on the share member, and wherein the biased spring is clamped between the transmission lever and the share member and normally holds the transmission lever against an abutment.

18. A street clearing device comprising:

a share member adapted to be moved by a vehicle over a surface to be cleared, a rotary member supported below the share member, a hard scraping blade and an elastic scraping blade mounted at an angle with respect to each other on said rotary member so that the hard or the elastic scraping blade selectively adopts an operative position with respect to the surface to be cleared, in dependence on the angle of rotation position of the rotary member, and the respective other scraping blade is oriented substantially upwardly or rearwardly, a toggle lever with two legs supporting the rotary member against rotation, a mounting device holding the toggle lever at least approximately straight in the operative position of the hard scraping blade and bent in the operative position of the elastic scraping blade, wherein both legs of the toggle lever are adapted to yield, against the resistance of a biased spring, in their common longitudinal direction, when in their at least approximately straight position, so as to permit the hard scraping blade to make evading movements to the rear, wherein the mounting device is so arranged that it remains at least substantially unloaded and unchanged in length during evading movements of the hard scraping blade, and wherein the toggle lever is adapted to be telescoped together, when in its at least approximately straight position, and the biased spring is mounted on the toggle lever proper such that it resists said telescoping movement.

19. A street clearing device comprising:

a share member adapted to be moved by a vehicle over a surface to be cleared, a rotary member supported below the share member, a hard scraping blade and an elastic scraping blade mounted at an angle with respect to each other on said rotary member so that the hard or the elastic scraping blade selectively adopts an operative positions with respect to the surface to be cleared, in dependence on the angle of rotation position of the rotary member, and the respective other scraping blade is oriented substantially upwardly or rearwardly, a toggle lever with two legs supporting the rotary member against rotation, a mounting device holding the toggle lever at least approximately straight in the operative position of the hard scraping blade and bent in the operative position of the elastic scraping blade, wherein both legs of the toggle lever are adapted to yield, against the resistance of a biased spring, in their common longitudinal direction, when in their at least approximately straight position, so as to permit the hard scraping blade to make evading movements to the rear, wherein the mounting device is so arranged that it remains at least substantially unloaded and unchanged in length during evading movements of the hard scraping blade, and wherein the mounting device is connected with the share member by a first joint and with the toggle lever by a second joint spaced therefrom, the first joint being spaced at least approximately equally from the positions which the second joint adopts when the hard scraping blade is in its operative position on the one hand and in its rearmost position of obstruction on the other hand.

* * * * *